United States Patent [19]

Gabor et al.

[11] 4,315,453

[45] Feb. 16, 1982

[54] PERCUSSION AID

[76] Inventors: Charles Gabor, c/o George Spector, 3615 Woolworth Bldg., 233 Broadway; George Spector, 3615 Woolworth Bldg., 233 Broadway, both of New York, N.Y. 10007

[21] Appl. No.: 113,310

[22] Filed: Jan. 18, 1980

[51] Int. Cl.[3] ..... G10D 13/02

[52] U.S. Cl. ..... 84/422 R

[58] Field of Search ..... 84/422, 465

[56] References Cited

U.S. PATENT DOCUMENTS 1,362,271 12/1920 Stathopoulos ..... 84/422 R 2,417,972 3/1947 D'Arcy ..... 84/422 H 3,443,471 5/1969 Di Muzio ..... 84/465

4,028,984 6/1977 Sanchez ..... 84/422 C

*Primary Examiner*—Lawrence R. Franklin

[57] ABSTRACT

A holder for supporting a drum stick that strikes a cymbol the holder including a collar locked by a set screw to the cymbol supporting post, a sleeve through which the drum stick is inserted and a coil spring between the collar and sleeve; the drum stick being pivotable about the holder, thus amade, which one end of the drum stick is pulled by a wire attached to a bass drum foot pedal, including vibration dampening device for the drum stick.

5 Claims, 7 Drawing Figures

SPRING INSIDE SMALL ROUND BOX

PERCUSSION AID

This invention relates generally to musical equipment. More specifically it relates to percussion instrument accessories.

It is well known that in many musical compositions, the technical ability of a drum player is tapped to the limit by demanding a rapid performance on a bass drum, cymbol and snare drums all at a same time.

It is a principal object of the present invention to provide an accessory whereby a cymbol is played automatically when a bass drum is struck by a foot-pedal operated mallet, thereby freeing the player's hand for operating other instruments.

Another object is to provide a percussion aid which includes a coil spring that vibrates so to produce repeated beating of the stick, and the spring including an adjustment means for changing a stick beat tempo.

Figures 1, 2, 3, 4, 5, 6, 7:
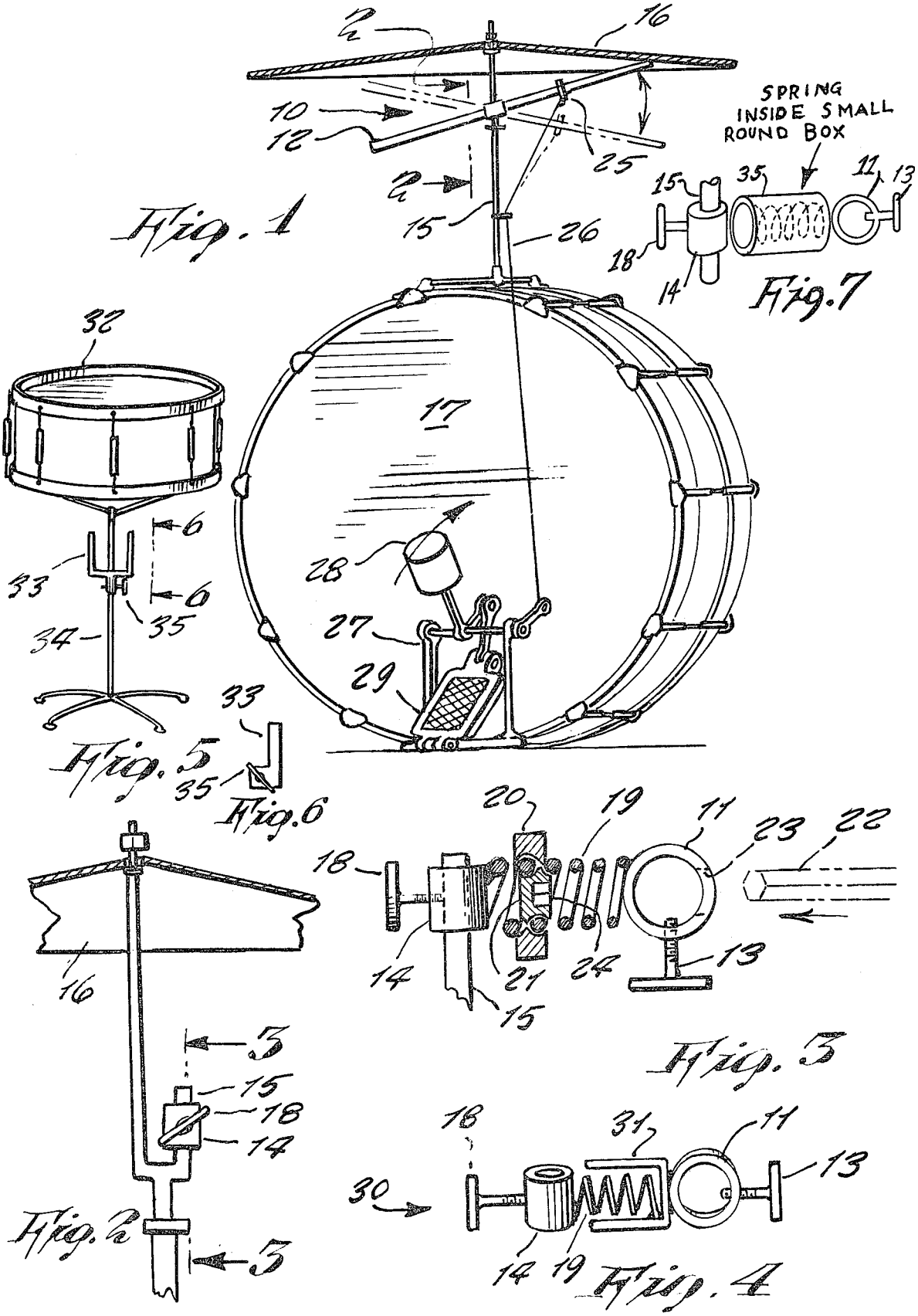
FIG. 1 is a perspective view of the invention.
FIG. 2 is an enlarged detail side view on line 2—2 of FIG. 1.
FIG. 3 is a further enlarged detail side view on line 3—3 of FIG. 2, and showing a novel spring tension adjustment means by making the spring from a tapered thickness wire and including adjustable nuts threaded around the spring for selected spring turn use.
FIG. 4 is a similar view of another design thereof incorporating just a plain spring without the adjustment means.
FIG. 5 is a view of a snare drum and showing a drum and showing a drum stick holder on a stand thereof for playing the same.
FIG. 6 is a view indirection 6—6 of FIG. 5.
FIG. 7 is a modification providing vibration dampening device for the drum stick.

Referring now to the drawing in greater detail, andmore particularly to FIGS. 1, 2 and 3 thereof at this time, the reference numeral 10 represents a percussion aid according to the present invention wherein there is a sleeve 11 through which a drum stick 12 is inserted and secured by means of a set screw 13, the stick protruding from both ends of the sleeve.

A collar 14 is slidable along a post 15 that supports a big cymbol 16 on top of a bass drum 17, the collar being secured in selected position along the post by means of a set screw 18.

A coil spring 19 is welded at one end to the sleeve 11 and is welded at its other end to the collar 14, the spring is made from a tapering wire so that the coil is increasingly more resilient toward its one end. The coil turns are all a same pitch diameter and the turns are a same distance apart.

A nut 20 is threaded around an outer side of the spring while an internal nut 21 is threaded inside the coil spring. By adjusting the nuts axisally further apart or closer together, and at either the more thicker or thinner wire turns of the coil, the flexibility of the coil can be adjusted selectively in order that the stick can thus repeatedly strike the cymbol either more rapidly or shower, as wished.

Adjustment of the interior nut is accomplished by a hexagonal faced rod 22 being inserted through a clearance hole 23 in the sleeve and engaging a hexagonal hole 24 in the nut.

In operative use a ring 25, affixed near one end of the stick, is attached to a wire 26 of a type such as is used on bicycle brakes, and which in this invention is attached to a foot pedal mechanism 27 used in striking mallet 28 against the bass drum whenever the pedal 29 is depressed.

In FIG. 4, a modified design of stick holder 30 is generally a same as stick holder 10 except that the nuts 20 and 21 are not employed, so that a vibration of the spring is not adjustable. However, a U-shaped bracket 31 secured to the sleeve encloses the spring on opposite two sides, set screw 13 being located at the end of sleeve 11 to clear bracket 31.

FIGS. 5 and 6 illustrate the present invention adaptable to holding a drum stick for a snare drum 32; the holder 33 being designed to support a pair of drum sticks which may differ in position to each other. The holder is adjustably secured on a stand 34 by means of set screw 35. The means for securing the pivotal drum sticks on the holder 33 being similar to that used to mount the drum stick 12 on post 15.

In FIG. 7 a cylindrical enclosure 35 is rotatably mounted on coil spring 19 in order to dampen the vibrations of the drumstick after each beat to ensure clear accurately timed beats. The contact between the spring and enclosure 35 providing the dampening effect. The coil spring may be in threaded engagements with the enclosure to adjust the flexibility of the coil for the purposes described heretofore in connection with FIG. 3.

It is understood that all forms of this invention resulting from modifications within the skill of a skilled mechanic are in the scope of this invention.

What is claimed as new, is:

1. A percussion aid device comprising a collar for adjustably securing said device on a cymbol post in combination with a sleeve adapted to adjustably receive a drumstick therein including resilient means connecting said sleeve pivotally to said collar said device being mounted adjacent a cymbol whereby the drumstick may be resiliently pivotally displaced relative the collar to strike the cymbol, in further combination with a wire connected to drumstick and a foot pedal, including means to adjust the torsional resiliency of the said resilient means.

2. A device as in claim 1 wherein the resilient means is a coil spring and the second said means comprises a nut assembly threadedly mounted on the spring.

3. A device as in claim 1 wherein the resilient means is a coil spring including further means to dampen spring vibration.

4. A device as in claim 3 wherein the last said means is a cylinder enclosing said spring.

5. A device as in claim 5 wherein said device includes a pair of sleeves to hold a pair of drumsticks.

* * * * *